US009103161B2

(12) United States Patent
Mader

(10) Patent No.: US 9,103,161 B2
(45) Date of Patent: Aug. 11, 2015

(54) SPACER TAPE

(75) Inventor: Leopold Mader, Neuhofen/Ybbs (AT)

(73) Assignee: LISEC AUSTRIA GMBH, Seitenstetten (AT)

( * ) Notice: Subject to any disclaimer, the term of this patent is extended or adjusted under 35 U.S.C. 154(b) by 726 days.

(21) Appl. No.: 13/376,977

(22) PCT Filed: Jan. 17, 2011

(86) PCT No.: PCT/AT2011/000023

§ 371 (c)(1),
(2), (4) Date: Dec. 8, 2011

(87) PCT Pub. No.: WO2011/088484

PCT Pub. Date: Jul. 28, 2011

(65) Prior Publication Data

US 2012/0094040 A1 Apr. 19, 2012

(30) Foreign Application Priority Data

Jan. 20, 2010 (AT) ..... 71/2010

(51) Int. Cl.
*E06B 3/663* (2006.01)

(52) U.S. Cl.
CPC ..... *E06B 3/66361* (2013.01); *E06B 3/663* (2013.01); *E06B 3/66352* (2013.01); *E06B 2003/66385* (2013.01); *Y10T 428/13* (2013.01)

(58) Field of Classification Search
CPC . E06B 3/663; E06B 3/66352; E06B 3/66366; E06B 3/673; E06B 3/67313; E06B 3/6733
USPC ..... 428/34, 36.9, 157, 192, 426; 52/786.13; 156/109, 250
See application file for complete search history.

(56) References Cited

U.S. PATENT DOCUMENTS

| | | | | |
|---|---|---|---|---|
| 4,719,728 | A * | 1/1988 | Eriksson et al. | 52/172 |
| 5,531,047 | A * | 7/1996 | Leopold et al. | 52/172 |
| 5,775,393 | A | 7/1998 | Kovacik | |
| 6,212,756 | B1 * | 4/2001 | Ferri | 29/527.1 |

(Continued)

FOREIGN PATENT DOCUMENTS

| | | |
|---|---|---|
| CN | 1100174 A | 3/1995 |
| DE | 43 13 364 | 10/1994 |

(Continued)

OTHER PUBLICATIONS

Machine translation of FR 1248713, Dec. 1960.*

(Continued)

*Primary Examiner* — Donald J Loney
(74) *Attorney, Agent, or Firm* — Young & Thompson

(57) ABSTRACT

A spacer tape (9) for insulating glass (2) with at least two glass panes (3 and 5) consists of a substrate strip (21) and a hose (20) that is connected to the latter. The hose (20) can be pressed together, e.g., folded, so that its dimension, viewed crosswise to the longitudinal extension of the substrate strip (21), can be reduced, and the spacer tape (9) can be wound on drums. For use, the hose (20) is expanded, e.g., unfolded, and a compound (15), containing hygroscopic material, is introduced into its interior, which can take place by the longitudinally extending slot (25) in the hose (20). Then, the side walls (27) of the hose (20) are coated with adhesive (13), and at least two glass panes (3 and 5) of insulating glass (1) can be assembled with use of the spacer tape (9) as a spacer.

15 Claims, 3 Drawing Sheets

(56) References Cited

U.S. PATENT DOCUMENTS

| | | | | |
|---|---|---|---|---|
| 6,279,292 | B1 * | 8/2001 | Shah et al. | 52/786.13 |
| 6,823,644 | B1 | 11/2004 | Peterson | |
| 2007/0275192 | A1 | 11/2007 | Lisec | |

FOREIGN PATENT DOCUMENTS

| | | |
|---|---|---|
| EP | 0 753 638 | 1/1997 |
| EP | 1 101 955 | 5/2001 |
| FR | 1 248 713 | 12/1960 |
| GB | 2302903 A | 2/1997 |

OTHER PUBLICATIONS

Machine translation of EP 1101955, May 2001.*
Translation of Chinese Office Action, dated Jan. 17, 2014, from corresponding CN application.
International Search Report dated Jun. 16, 2011, corresponding to PCT/AT2011/000023.
Australian Patent Examination Report, dated Jul. 4,2014, from corresponding AU application.

* cited by examiner

SPACER TAPE

The invention relates to a spacer tape, as it is used for insulating glass, to connect the glass panes at a distance from one another.

BACKGROUND OF THE INVENTION

Spacers are known in the most varied embodiments, whereby spacers that consist of metal hollow sections are also known, such as spacers in the form of plastic tapes.

Spacers that have two substrate strips made of stainless steel are also known. Between the substrate strips, a plastic element is provided that is connected to the substrate strips. Thus, the substrate strips are held parallel to one another and at a distance from one another.

A plastic compound, which contains molecular sieve as a desiccant, is introduced into the space between the two substrate strips. Holes are provided in the strips of the spacer tape that lie inside the insulating glass so that the molecular sieve can remove moisture from the air or the gas in the space between the glass panes of the insulating glass to prevent the insulating glass from fogging up on the inside.

In the case of these known spacers with two substrate strips that are parallel to one another and connected to one another, it is problematic that the latter can be wound only with difficulty, on the one hand, since they are rigid, on the one hand, and since they have to be packaged airtight for transport, so that the hygroscopic material (molecular sieve) does not lose its effectiveness, on the other hand.

The object of the invention is to propose a spacer tape that does not have the above-mentioned drawbacks.

BRIEF SUMMARY OF THE INVENTION

This object is achieved according to the invention with a spacer tape that has the features of Claim 1.

Preferred and advantageous configurations of the spacer tape according to the invention are the subject of the subclaims.

Since the spacer tape according to the invention consists of a substrate strip and a flexible hose that can be pressed together (folded) connected to this substrate strip, the spacer tape can easily be wound in the case of a hose that is rolled up flat or folded up since it can be bent with no ill effects. When the spacer tape is then used as a spacer for insulating glass, the hose is expanded, e.g., unfolded; this can be done, for example, by expanding the hose, when the spacer tape from a supply drum is unrolled, i.e., is pulled out. Then, a compound that contains the desiccant (hygroscopic material, e.g., molecular sieve) is sprayed into the interior of the hose. After an adhesive is applied to the sides of the spacer tape, in particular an adhesive based on butyl rubber, the spacer tape according to the invention can be used when assembling insulating glass as a spacer by its being applied to one of the glass panes, and then the second glass pane being placed. It is possible to bend the spacer according to the invention in the corner area at any angle so that the forming of one-piece corners is easily possible. This is possible since the hose can be folded and does not hinder the bending of the spacer tape according to the invention in the corner area.

Within the framework of the invention, consideration is also given to improving the bond of the glass panes via the spacer tape by having the latter be coated in its outlying areas, in particular the hose, with an adhesive strip, e.g., an acryl-based adhesive, which is covered with masking tape before use, so that when rolling up the spacer tape with hose that is rolled up flat, e.g., folded up, coils of the spacer tape lying above one another do not stick together.

For the cross-sectional shape of the hose, any embodiments are possible as long as the hose can be pressed together or folded up only crosswise to its longitudinal extension, i.e., approximately perpendicular to the plane of the substrate tape or substrate strip. For example, consideration is also given to trapezoidal cross-sectional shapes, and rectangular cross-sectional shapes, such as cross-sectional shapes with convex or concave side walls, e.g., side walls that are angled approximately in the shape of a sigma.

When the spacer tape according to the invention is used for three-pane insulating glass, it is preferred when the middle pane of the three-pane insulating glass is held in the spacer tape, in particular in the compound containing the desiccant, which is contained in the (unfolded) hose.

BRIEF DESCRIPTION OF THE SEVERAL VIEWS OF THE DRAWINGS

Additional details and features of the invention follow from the description below of preferred embodiments based on the drawings. Here.

DETAILED DESCRIPTION OF THE INVENTION

Figure 1:
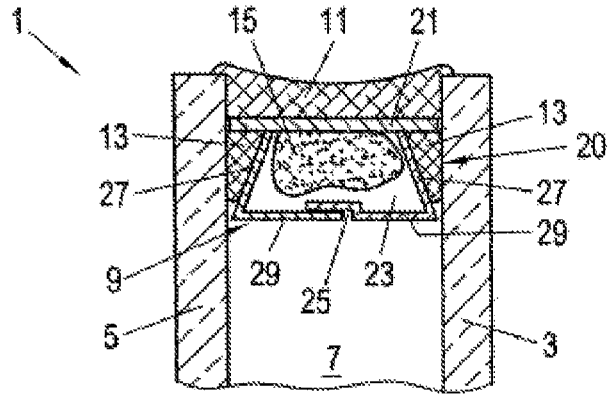
FIG. 1 shows an insulating glass (partial two-pane insulating glass) with a spacer that consists of a spacer tape according to the invention.

An insulating glass 1 shown in FIG. 1 has two glass panes 3, 5, which enclose a gap 7 between them. The gap 7 is limited toward the edge of the insulating glass 1 by a spacer that consists of spacer tape 9, which connects the panes 3, 5 at a distance from one another. Sealing compound 11 is introduced into the edge seam that is open toward the outside between the spacer tape 9 and the outer edges of the glass panes 3 and 5.

To connect the panes 3 and 5 of the insulating glass 1 together via the spacer tape 9, the spacer tape 9 is coated laterally in the region of its hose 20 with adhesive 13 that is based on, for example, a butyl rubber adhesive.

In the embodiment shown in FIG. 1, the spacer tape 9 consists of a substrate strip 21, which is, for example, a strip made of metal, in particular stainless steel, and a hose 20, which is connected to the substrate strip 21 as desired, e.g., welded or glued. The hose 20 of the spacer tape 9 is formed from two side walls 27 and the inner walls 29 that limit the gap 7. Between the walls 29, there is a longitudinally extending slot 25, which makes it possible for the desiccant (molecular sieve) introduced into the interior of the hose 20, which can be embedded in a compound 15, to exert its action to remove water in the gap 7 of the insulating glass 1 and to prevent the interior of the glass panes 3 and 5 from fogging up.

Figure 2:
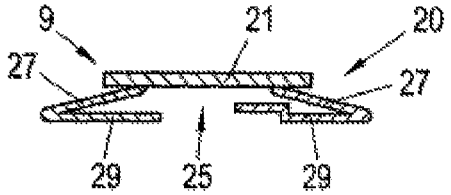
FIG. 2 shows the spacer tape from FIG. 1 with a hose that is rolled up flat.
Figure 3:
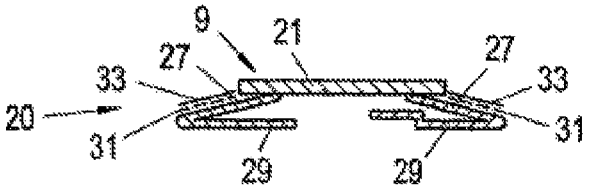
FIG. 3 shows a variant of the embodiment of FIG. 2.

Consideration is given to introducing the compound 15 with hygroscopic material into the interior of the hose 20 of the spacer tape 9 after the latter has been unfolded from its position, rolled up flat or folded, shown in FIG. 2 or 3, into the form shown in FIG. 1.

FIGS. 2 and 3 show how the hose 20 of the spacer tape 9 from FIG. 1 is folded up flat, whereby it is considered that the folding goes to the extent that the side walls 27 just like the walls 29 are moved essentially up to the substrate strips 21. Only once the spacer 9 is unrolled from its supply drum is the hose 20 expanded (unfolded) from its folded-up position into the deployed position shown in FIG. 1, and the compound 15 that contains hygroscopic material is sprayed into its interior via the gap 25. Then, adhesive 13 (butyl rubber) is applied on the lateral surfaces 27 of the hose 20, and the spacer 9 can be used when assembling insulating glass panes. Although the outside surfaces of the strands of adhesive 13 are depicted in convex form in the figures, the latter can be flat to simplify the assembly of the insulating glass 1, i.e., to reduce the work involved in pressing.

FIG. 3 shows that layers 31 that consist of adhesive can be provided on the side walls 27 of the hose 20, and said layers are covered with masking tape 33, so that the layers of the spacer tape 9, when the latter is wound on supply drums with a hose 20 that is folded up flat, do not stick together. The masking tape 33 is removed when the spacer tape 9 is applied to one of the glass panes 2 or 5.

Figure 4:
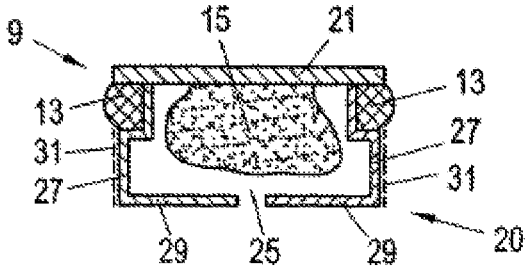
FIG. 4 shows another embodiment of a spacer tape.

In the embodiment shown in FIG. 4, the hose 20 of the spacer tape 9 is designed essentially rectangular (box-like). In this case, in the lateral walls 27 of the hose 20, stages are provided to form space for accommodating adhesive 13. This hose 20 can be rolled up flat by (e.g., like a parallelogram) folding around its side walls 27 and bending the inside walls 29.

Figure 5:
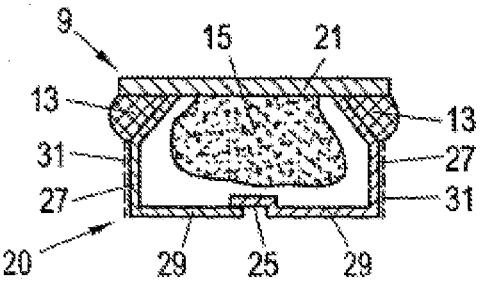
FIG. 5 shows another embodiment of a spacer tape.

In the embodiment shown in FIG. 5, the hose 20 is designed essentially trapezoidal, whereby the side walls 27 are designed bent sharply.

Both in the embodiment according to FIG. 4 and in any embodiment according to FIG. 5, the side walls 27 bear layers made of adhesive 31 in their region facing away from the substrate strips 21.

Figure 6:
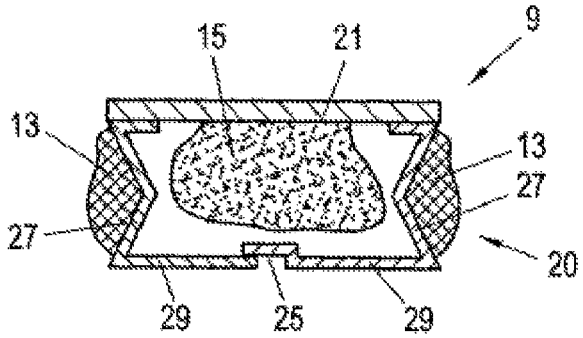
FIG. 6 shows an embodiment of the spacer tape with side walls designed in a concave manner.

In the embodiment shown in FIG. 6, the hose 20 can be folded, since its side walls 27 are bent sharply inward, so that as a whole, a sigma-shaped configuration of the lateral region of the hose 20 is present. The adhesive 13 can be introduced into the regions of the side walls 27 that are bent sharply inward.

Figure 7:
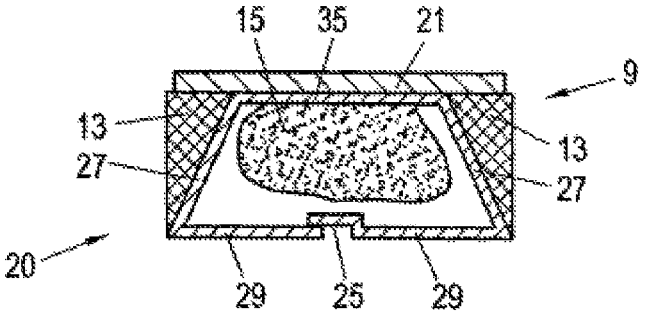
FIG. 7 shows an alteration of the embodiment of FIG. 2 with an expanded hose.
Figure 8:
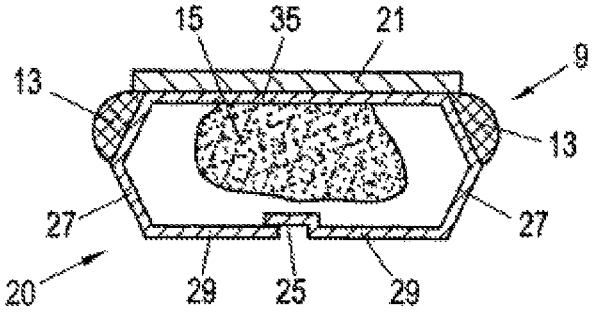
FIG. 8 shows another embodiment of a spacer tape.
Figure 9:
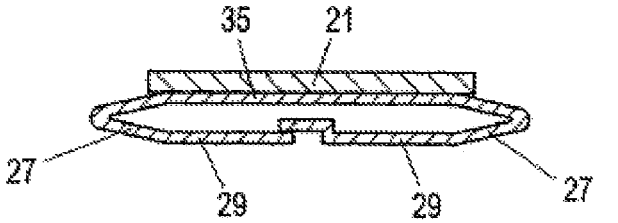
FIG. 9 shows the spacer tape of FIG. 8 with a hose that is rolled up flat.

As indicated in, for example, FIGS. 7, 8 and 9, the hose 20 of the spacer tape 9 can have side walls 27 that are connected together via a wall 35. The hose 20 can also be connected to the substrate strip 21 via this wall 35.

The embodiment shown in FIGS. 8 and 9, in which the side walls 27 can be connected to one another via a wall 35, can also be implemented as alternatives in the embodiments shown in FIGS. 1 to 6 (cf. FIG. 7). That is to say, the side walls 27 are connected (welded, glued, and the like) either to the substrate strip 21 via their edges that adjoin the substrate strip 21 or else they are connected to one another via the wall 35 and via the wall to the substrate strip 21.

It can be seen from the embodiment shown in FIGS. 8 and 9 that the side walls 27 of the hose 20 are shown not only as in FIG. 6 in concave form but also can be designed in convex form, e.g., bent sharply.

From FIG. 9, it is also seen how the embodiment of a spacer tape 9 shown in FIG. 8 is designed, when it is wound on a supply drum, i.e., the hose 20 is thus pressed flat, by its inner boundary walls 29 being brought toward the substrate strip 21 and the side walls 27 being almost or completely bent sharply toward one another.

Figure 10:
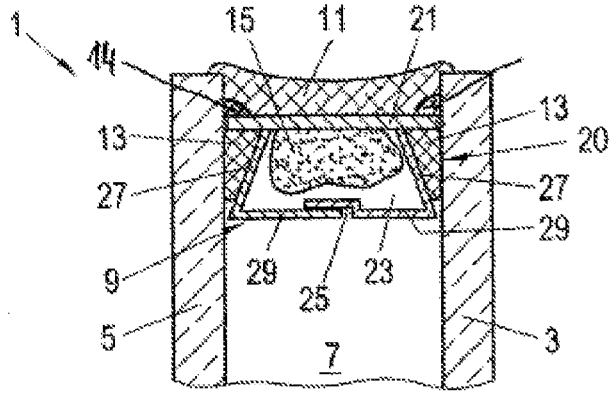
FIG. 10 shows a variant of the embodiment of FIG. 1.

As shown in FIG. 10, at least in assembled insulating glass 1, the adhesive 13 can grip with its regions 14*b* over the outside of the substrate strip 21.

Figure 11:
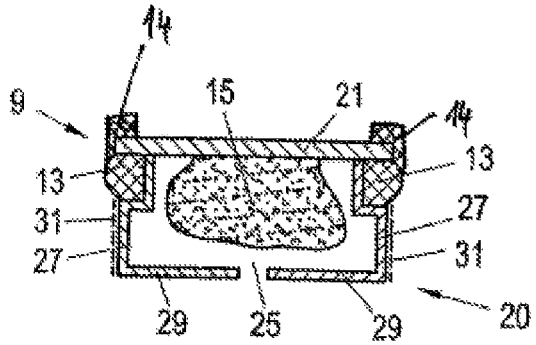
FIG. 11 shows a variant of the embodiment of FIG. 4.

FIG. 11 shows that the strands of adhesive 13 extend over the lateral edges of the substrate strip 21 with regions 14 from above on both sides of the spacer tape 9 and extend up to its side that lies outside in the insulating glass 1.

Figure 12:
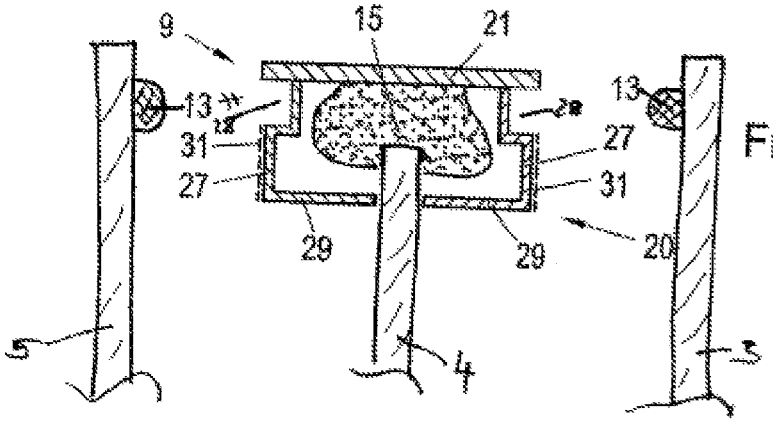
FIG. 12 shows the application of a spacer tape according to the invention to the middle pane of three-pane insulating glass.

In the example of a triple insulating glass, FIG. 12 shows that during assembly, adhesive 13 is applied in two strands to the inside of the panes 3 and 5, whereby the strands that consist of adhesive 13 extend in particular around the edge of the panes 3 and 5. When the insulating glass is pressed into the insulating glass blank (without the sealing compound 11), the strands that consist of adhesive 13 enter the outside recesses 28 in the side walls 27 of the hose 9 and extend over the latter, as is shown in principle in FIG. 10, with the substrate strip 21 with its regions 14 up to its side lying outside in the insulating glass 1.

FIG. 12 shows that a middle pane 4 of the insulating glass 1 (three-pane insulating glass) engages its lateral edge (outside edge) in the compound 15, in which the desiccant (molecular sieve) is contained, and it is held securely.

In all embodiments of spacer tapes 9 according to the invention, it can be provided that the material (in particular an elastic plastic) is formed from which the hose 20 has elasticity properties such that the hose 20, as soon as the spacer tape 9 is unwound from the supply drum, automatically straightens out under the action of elastic deformation from the flat shape shown in, for example, FIG. 2 or FIG. 3 or FIG. 9 into the form in which is it present in the finished spacer tape 9, as is shown in, for example, FIGS. 1 and 4 to 8.

The introduction of the compound (matrix) 15, which contains desiccant, i.e., hygroscopic material, for example in the form of molecular sieve, is done by the longitudinal slot 25. In this case, it can be provided that a through-going strand made of compound 15 is sprayed into the interior of the hose 20 of the spacer tape 9, or else individual portions of matrix 15 are introduced at discrete points.

In summary, an embodiment of the invention can be described as follows.

A spacer tape 9 for insulating glass 2 with at least two glass panes 3 and 5 consists of a substrate strip 21 and a hose 20 that is connected to the latter. The hose 20 can be pressed together, e.g., folded, so that its dimension, viewed crosswise to the longitudinal extension of the substrate strip 21, can be reduced, and the spacer tape 9 can be wound on drums. For use, the hose 20 is expanded, e.g., unfolded, and a compound 15, containing hygroscopic material, is introduced into its interior, which can happen by the longitudinally extending slot 25 in the hose 20. Then, the side walls 27 of the hose 20 are coated with adhesive 13, and at least two glass panes 3 and 5 of insulating glass 1 can be assembled with use of the spacer tape 9 as a spacer.

The invention claimed is:

1. A spacer for insulating glass, the spacer being a spacer tape, comprising:

a substrate strip; and a compressible hose that comprises two side walls and that is configured to be folded into a reduced height configuration, to reduce its height, and unfolded, said height being measured crosswise to a longitudinal extension of the substrate strip, wherein an interior of the hose of the spacer tape is accessible by a longitudinally extending slot, wherein said hose comprises two inner walls configured to face an air gap of insulating glass that define said slot therebetween, and wherein the hose is configured to transition from a folded state in which the hose is in the reduced height configuration by expanding to an unfolded, deployed state such that the spacer tape is configured to be used as the spacer for insulating glass.

2. The spacer according to claim 1, wherein when the hose is in said reduced height configuration, two side walls of said hose are laid flat or bent sharply into a layer that is approximately parallel to the substrate strip, and two inner walls of said hose are moved toward the substrate strip.

3. The spacer according to claim 1, wherein two side walls of said hose are configured to be bent sharply toward an inside or an outside of said hose so that the hose is folded to increasingly reduce an angle between sections of the side walls and to move an inside wall to the substrate strip.

4. The spacer according to claim 1, wherein the substrate strip comprises metal.

5. The spacer according to claim 1, wherein the substrate strip comprises plastic.

6. The spacer according to claim 1, wherein the hose comprises plastic.

7. The spacer according to claim 1, wherein the hose comprises elastic material.

8. The spacer according to claim 1, wherein side walls of said hose are connected to each other via a wall.

9. The spacer according to claim 8, wherein the hose is connected via the wall to the substrate strip.

10. An insulating glass with the spacer according to claim 1, wherein the spacer is arranged between two panes and is connected to the panes by strands that comprise adhesive, and wherein the strands that comprise adhesive encompass lateral longitudinal edges of the substrate strip and extend up to an outlying surface of said substrate strip in the insulating glass.

11. The insulating glass according to claim 10, comprising two outside panes and a middle pane, wherein the middle pane engages a compound, in which desiccant is embedded, and is arranged within the hose of the spacer.

12. A method for assembling insulating glass with a spacer according to claim 1 and two glass panes comprising:

connecting said two glass panes to the spacer with adhesive, applying strands that comprise adhesive on interiors of the two panes, and then connecting the panes with a spacer by pressing.

13. The method according to claim 12, wherein when the panes are pressed with the spacer, adhesive is pressed around lateral edges of the substrate strip of the spacer up to an exterior of the substrate strip.

14. The method according to claim 13, wherein the adhesive is pressed into lateral walls of the hose of the spacer when the insulating glass is assembled and pressed into recesses of the spacer.

15. The spacer according to claim 1, wherein the hose comprises two side walls and two inner walls facing an air gap of insulating glass, where said side walls form the slot between them.

* * * * *